US009387911B2

(12) United States Patent
Jamieson et al.

(10) Patent No.: US 9,387,911 B2
(45) Date of Patent: Jul. 12, 2016

(54) LAUNCH AND RECOVERY TECHNIQUES FOR SUBMERSIBLE VEHICLES AND OTHER PAYLOADS

(71) Applicant: Subsea 7 Limited, Sutton (GB)

(72) Inventors: James Andrew Jamieson, Balmedie (GB); Graham Gibbons, Perth (GB); Lee Wilson, Insch (GB)

(73) Assignee: Subsea 7 Limited, Sutton (GB)

( * ) Notice: Subject to any disclaimer, the term of this patent is extended or adjusted under 35 U.S.C. 154(b) by 0 days.

(21) Appl. No.: 14/358,718

(22) PCT Filed: Nov. 15, 2012

(86) PCT No.: PCT/GB2012/052838

§ 371 (c)(1),
(2) Date: May 15, 2014

(87) PCT Pub. No.: WO2013/072690

PCT Pub. Date: May 23, 2013

(65) Prior Publication Data

US 2015/0086299 A1 Mar. 26, 2015

(30) Foreign Application Priority Data

Nov. 15, 2011 (GB) ..... 1119696.1

(51) Int. Cl.

| | |
|---|---|
| ***E21B 41/04*** | (2006.01) |
| ***B63B 27/08*** | (2006.01) |
| ***B63C 11/42*** | (2006.01) |

(Continued)

(52) U.S. Cl.

CPC ..... *B63B 27/08* (2013.01); *B63B 27/00* (2013.01); *B63B 27/36* (2013.01); *B63C 7/20* (2013.01); *B63C 11/42* (2013.01); *B63G 8/001* (2013.01);

(Continued)

(58) Field of Classification Search

CPC ..... B63G 8/001; B63G 2027/165; B63G 2008/008; B63G 2008/004; B63G 2008/002

USPC ..... 114/258, 259, 322, 368, 375, 377, 378, 114/382, 48, 51, 73; 212/308; 254/277, 254/900; 405/188, 191, 200, 3; 414/139.5, 414/139.6

See application file for complete search history.

(56) References Cited

U.S. PATENT DOCUMENTS

| | | | |
|---|---|---|---|
| 3,536,023 A | 10/1970 | Toher et al. | |
| 3,779,195 A | 12/1973 | Oeland, Jr. | |

(Continued)

FOREIGN PATENT DOCUMENTS

| | | | |
|---|---|---|---|
| EP | 1 125 838 | 8/2001 | |
| EP | 2196622 A1 * | 6/2010 | ..... B63C 11/42 |

(Continued)

*Primary Examiner* — Gregory Adams
(74) *Attorney, Agent, or Firm* — Levy & Grandinetti

(57) ABSTRACT

A subsea payload such as an AUV (autonomous underwater vehicle) or an AUV garage is lifted from an underwater location by flying a latch unit through the water to the payload. The latch unit carries a lift line toward the payload. The latch unit is then attached to the payload and the payload is lifted using tension applied through the lift line via the latch unit. The latch unit can also be used on a lift line to lower a payload and then to release the payload at an underwater location. The lift line is supported by a heave-compensating winch on a surface vessel that effects z-axis movement of the latch unit. The winch maintains tension on the lift line to prevent the lift line falling on the payload. Movement of the latch unit on x- and y-axes is effected by on-board thrusters.

17 Claims, 5 Drawing Sheets

(51) Int. Cl.

| | |
|---|---|
| ***B63B 27/36*** | (2006.01) |
| ***B63G 8/00*** | (2006.01) |
| ***B63C 7/20*** | (2006.01) |
| ***B63B 27/00*** | (2006.01) |
| ***B66D 1/60*** | (2006.01) |

(52) U.S. Cl.

CPC ..... *B66D 1/60* (2013.01); *B63G 2008/004* (2013.01); *B63G 2008/007* (2013.01)

(56) References Cited

U.S. PATENT DOCUMENTS

| | | | | |
|---|---|---|---|---|
| 3,966,171 | A | 6/1976 | Hale | |
| 4,010,619 | A * | 3/1977 | Hightower et al. | 405/191 |
| 4,280,430 | A | 7/1981 | Wilson et al. | |
| 5,042,415 | A | 8/1991 | Hoffman | |
| 5,046,895 | A * | 9/1991 | Baugh | 405/188 |
| 6,257,162 | B1 * | 7/2001 | Watt et al. | 114/244 |
| 6,390,012 | B1 * | 5/2002 | Watt et al. | 114/322 |
| 6,935,262 | B2 * | 8/2005 | Roodenburg et al. | 114/258 |
| 7,296,530 | B1 * | 11/2007 | Bernstein et al. | 114/322 |
| 7,481,173 | B2 * | 1/2009 | Pollack et al. | 114/51 |
| 7,731,157 | B2 | 6/2010 | Davidson | |
| 7,854,569 | B1 | 12/2010 | Stenson et al. | |
| 2005/0276665 | A1 * | 12/2005 | Entralgo et al. | 405/190 |
| 2007/0272906 | A1 | 11/2007 | Davidson | |
| 2009/0308299 | A1 * | 12/2009 | Luccioni et al. | 114/230.23 |
| 2010/0189541 | A1 * | 7/2010 | Laenge | 414/803 |
| 2010/0212574 | A1 * | 8/2010 | Hawkes | B63C 11/42 114/328 |
| 2010/0260553 | A1 * | 10/2010 | Bryn et al. | 405/191 |
| 2011/0240303 | A1 * | 10/2011 | Hallundbaek | 166/339 |

FOREIGN PATENT DOCUMENTS

| | | |
|---|---|---|
| GB | 2 004 818 | 4/1979 |
| GB | 2 453 645 | 4/2009 |
| WO | WO 01/21476 | 3/2001 |
| WO | WO 01/21478 | 3/2001 |
| WO | WO 01/21479 | 3/2001 |
| WO | WO 2005/090226 | 9/2005 |
| WO | WO 2008/012473 | 8/2008 |

* cited by examiner

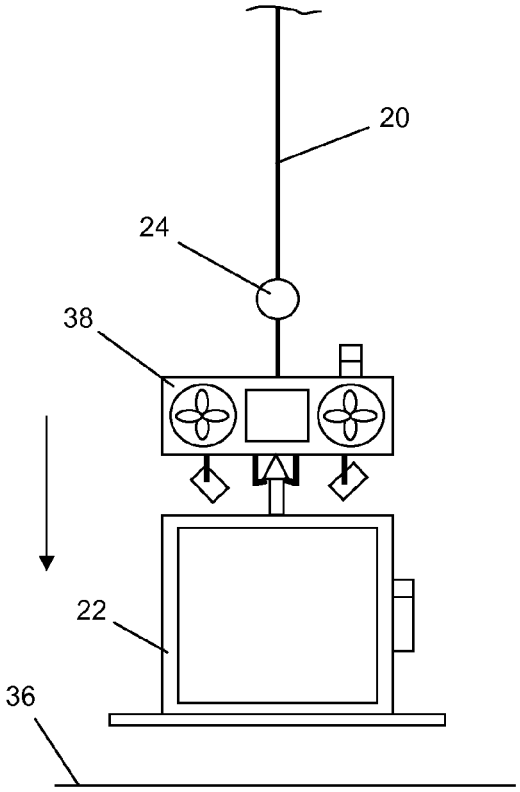
Figure 3
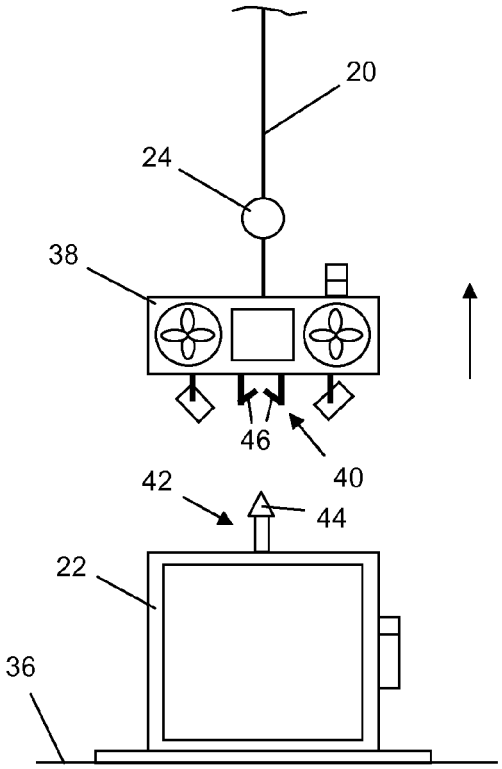
Figure 4
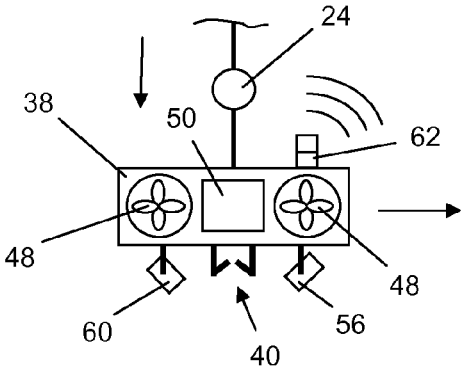
Figure 5
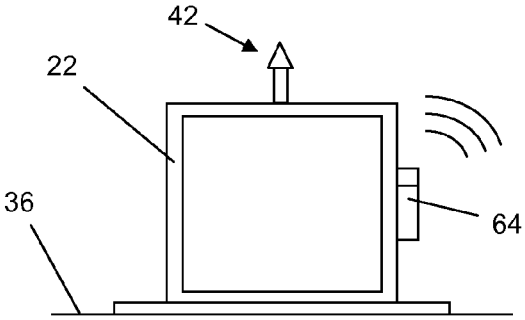

LAUNCH AND RECOVERY TECHNIQUES FOR SUBMERSIBLE VEHICLES AND OTHER PAYLOADS

This Application is the U.S. National Phase of International Application Number PCT/GB2012/052838 filed on Nov. 15, 2012, which claims priority to Great Britain Application No. 1119696.1 filed on Nov. 15, 2011.

This invention relates to the delivery and recovery of payloads to and from subsea locations, including the seabed and mid-water locations. The invention finds particular application in launch and recovery systems (LARS) for submersible vehicles used in deep-water engineering operations, such as autonomous underwater vehicles (AUVs).

An example of a LARS for an AUV is described in our earlier patent application published as GB 2453645. Here, an AUV is deployed on a submersible station, which may also be described as a dock or garage for the AUV. The station, with the AUV latched to it, is swung outboard from a support vessel on a wire hoist and is lowered quickly into the water. In this respect, it is advantageous to minimise the time spent transiting the turbulent splash zone near the water surface. Nevertheless, snatch loads may be caused by slack in the lift wire when the AUV/station assembly transits the splash zone in high sea states.

After clearing the splash zone, the AUV/station assembly is lowered to a fixed location on the seabed, from where the AUV will later unlatch from the station to execute its mission. Landing of the station on the seabed may be timed to minimise the effects of heave motion of the support vessel, but shock loads imparted on landing to both the lift wire and the AUV/station assembly can still be considerable. Shock absorbers may therefore be needed on the underside of the station.

Once landed, the lift wire is slackened to decouple the station from the motion of the support vessel, but this requires a flotation device to keep the lift wire above the station to minimise the risk of interference between the lift wire and the station.

At the end of the mission or at intervals during its mission, the AUV will typically return to the station for recovery, storage or re-charging. Until then, the station may be recovered to the support vessel for subsequent re-deployment elsewhere or at the same location, or it may be disconnected from the support vessel and left at the original landing site on the seabed to be recovered later.

Disconnecting the station, typically using an ROV or acoustic release, frees the support vessel for other tasks while the AUV executes its mission. However, reconnection requires an ROV and presents the challenge of locating the station and effecting reconnection in frequently adverse conditions at sea.

When the station is eventually to be recovered from the seabed, which is commonly soft mud into which the station will tend to embed, it may be necessary to overcome adhesion or suction forces between the station and the seabed. This can increase the severity of snatch loads in the lift wire when the station breaks free from the seabed.

An older prior art document, GB 2004818, shows that a moonpool on a support vessel may be enclosed and fitted with a floating pontoon to reduce the effect of waves when launching a submersible vehicle. However, this solution requires a vessel to be adapted specially at great cost. Where a vessel lacks a moonpool, GB 2004818 cannot solve the problem of wave motion.

WO 01/21476 discloses apparatus and methods for recovering a mid-water AUV in which a thruster-equipped flying latch vehicle is tethered to a subsea tether management system, which in turn is suspended from a surface vessel. Heave of the vessel is compensated for by slack in the tether between the latch vehicle and the submerged tether management system. However, the effects of heave are not removed: relative movement between the tether management system and the payload is merely minimised by slackening or winding in the tether at the appropriate time. This may compensate for heave when the latch vehicle is connecting to the mid-water AUV but it will not remove the effects of heave when the connected latch and the AUV are recovered to the tether management system. Consequently the overall system in WO 01/21476 does not compensate for heave of the surface vessel.

U.S. Pat. No. 7,854,569 discloses a thruster-equipped flying latch vehicle for capturing and recovering UAVs. That patent is primarily concerned with data transfer between the flying vehicle and the UAV and is not concerned with managing the tension in the lift line.

U.S. Pat. No. 3,779,195 describes apparatus and methods for recovering submerged objects such as stricken submarines. That patent does not disclose a thruster-equipped vehicle but instead uses a device that is guided to the object by picking up and following a messenger line deployed from the object. A constant-tension winch is disclosed, but this is not capable of compensating for heave of the surface vessel.

EP 1125838 describes a thruster-equipped surface vehicle for recovering an underwater vehicle but this operates only when the underwater vehicle is at the surface.

It is against this background that the present invention has been devised.

In one sense, the invention may be expressed as a method of lifting a payload such as an AUV or an AUV garage from an underwater location, comprising: flying a latch unit through the water to the payload, the latch unit being attached to a lift line to carry the lift line toward the payload; attaching the latch unit to the payload; and lifting the payload using tension applied through the lift line via the latch unit; wherein the lift line is supported by a heave-compensating winch on a surface vessel. Snatch loads on detaching the payload from a seabed location may be minimised by increasing tension progressively through the lift line.

In preferred embodiments to be described, flying the latch unit comprises moving the latch unit horizontally on x- and/or y-axes to align the latch unit above the payload before attachment. The latch unit may be moved on a z-axis toward the payload by paying out the lift line from the winch during movement of the latch unit on the x- and/or y-axes. In this respect, the latch unit may conveniently be lowered from the surface vessel on the lift line and be suspended underwater from the lift line with negative buoyancy.

The use of a heave-compensating winch allows the latch unit to be guided to and docked with the payload in a controlled and accurate manner, without unexpected variations in the z-axis position of the latch unit. Where the winch determines z-axis positioning so that the latch unit is on a taut lift line, this may be contrasted with the slack umbilical-type arrangements of the prior art that fly on the z-axis.

Underwater positions of the latch unit and the payload may be determined by known techniques and the latch unit may then be flown while monitoring its changing position to converge with the position of the payload.

Heave compensation by the winch is suitably activated when the latch unit is at a mid-water position near to, but vertically spaced from, the payload.

On detecting attachment of the latch unit to the payload, the winch advantageously applies tension to the lift line to prevent the lift line falling onto the payload. For this purpose, local tension may be sensed in a portion of the lift line closely adjacent the payload to control the winch. For example, a lift line tension sensor may be adjacent to or integrated with the latch unit.

The latch unit can also be used to lower a payload to an underwater location from which the payload is subsequently lifted or recovered. So, the lifting method of the invention may be preceded by lowering the payload to the underwater location attached to the latch unit attached, in turn, to the lift line; detaching the latch unit from the payload; and lifting the latch unit clear of the payload using the lift line. When lowering the payload through a splash zone near the surface, the method preferably comprises damping movement of the lift line, for example using a spring-compensated sheave supported by a surface vessel.

The inventive concept embraces a thruster-equipped latch unit that is steerable through water to a payload at an underwater location, the latch unit having an attachment to carry a lift line toward the payload and a latch formation to attach the latch unit to the payload, and being arranged to transmit lifting tension from the lift line to the payload via the attachment and the latch formation to recover the payload. The attachment is suitably disposed on one side of the latch unit and the latch formation is disposed on an opposite side of the latch unit to transmit tension from the lift line through the latch unit to the payload.

The inventive concept also finds expression in a system for recovering a payload from an underwater location, the system comprising: the latch unit of the invention, attached to a lift line; a heave-compensating winch for paying out the lift line to lower the latch unit toward the payload; a position-detection apparatus for detecting underwater positions of the latch unit and the payload; and a control apparatus acting on the winch and the latch unit to direct the latch unit to the payload. The control apparatus is suitably arranged to control one or more thrusters of the latch unit to move the latch unit on x- and/or y-axes and to control the winch to lower the latch unit on a z-axis by paying out the lift line from the winch.

The inventive concept also extends to a surface support vessel operating, or arranged to operate, the method of the invention or having the system of the invention.

By virtue of the invention, a subsea payload may be lowered, easily located and raised in various sea states while minimising transient forces experienced by the payload and by rigging that supports the payload. A support vessel requires minimal modification to benefit from the invention. The apparatus of the invention is inexpensive compared with changes to the architecture of a support vessel such as an enclosed moonpool as proposed in GB 2004818.

Some solutions provided by the invention may be used independently of a flying latch unit although they give synergistic benefits when used together:

- damping the movement of the lift line reduces launch loads caused by slack wire when lowering the payload through the splash zone;
- heave compensation by the winch lands the payload on the seabed or onto other subsea surface in a controlled manner, and allows the payload to be docked with and lifted with gentle, accurate movement;
- maintaining tension by the winch keeps the lift line clear of the payload while the payload is on the seabed or other subsea surface; and
- after landing, gradually increasing tension in the lift line lifts the payload from the seabed or other subsea surface in a controlled manner and controls any additional loads caused by the payload sticking in a muddy seabed.

In both WO 01/21476 and U.S. Pat. No. 7,854,569 noted above, the packages to be recovered are in mid water. In contrast, preferred applications of the invention relate to the delivery and recovery of a package to the seabed. In that context, the use of heave-compensated winches, damping of loads and/or constant tension systems ensures safe deployment and recovery through the splash zone, landing the package on the seabed in a controlled fashion and releasing it, and subsequently reconnecting and lifting the package from the seabed in a controlled manner while releasing any adhesion or suction.

In order that the invention may be more readily understood, reference will now be made, by way of example only, to the accompanying drawings in which:

FIG. 3 is an enlarged schematic side view of the latch unit and AUV basket of FIG. 2 while they are engaged to each other, just before the AUV basket is landed on the seabed;

Figure 2:
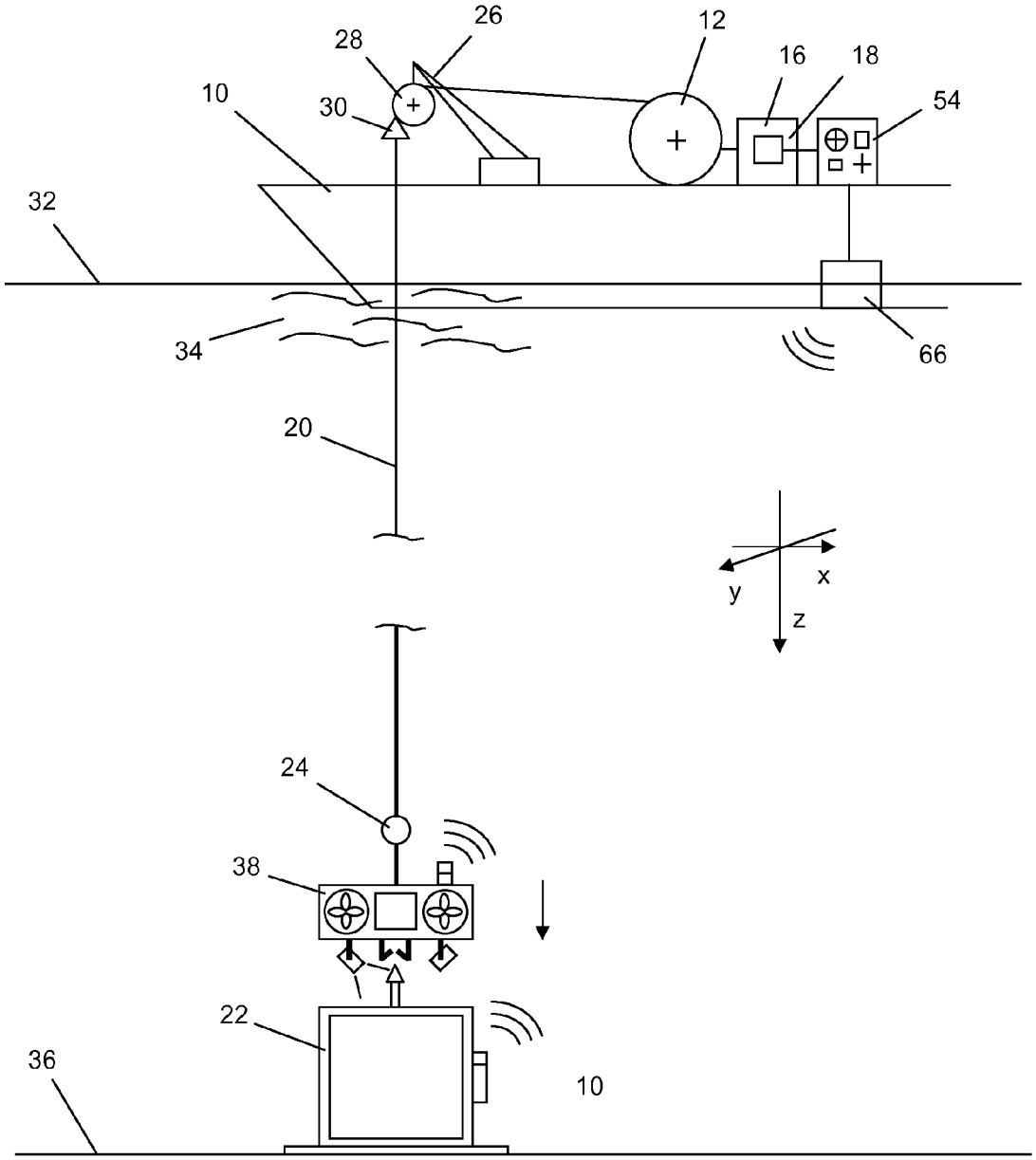
FIG. 2 is a schematic side view of a second embodiment of the invention in use, while lowering a flying latch unit from a support vessel to dock with an AUV basket previously placed on the seabed.
Figure 6:
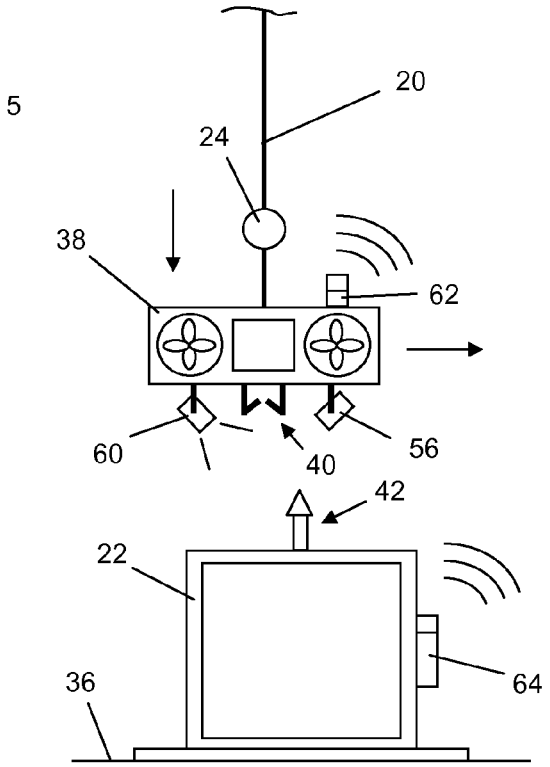
Figure 7:
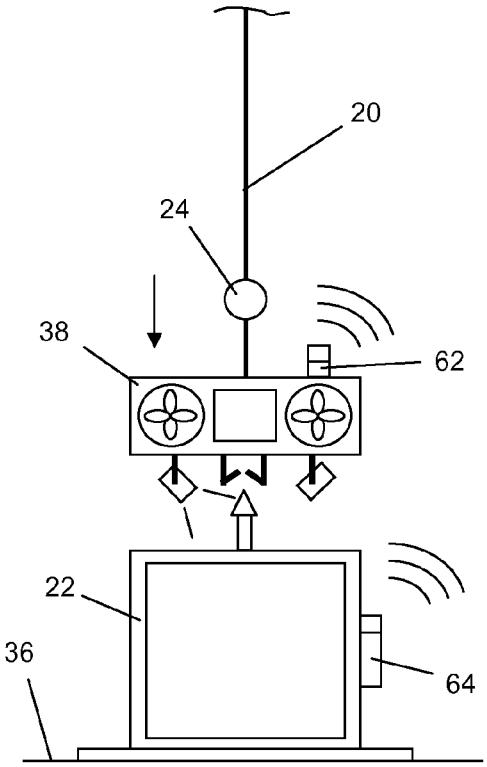
Figure 8:
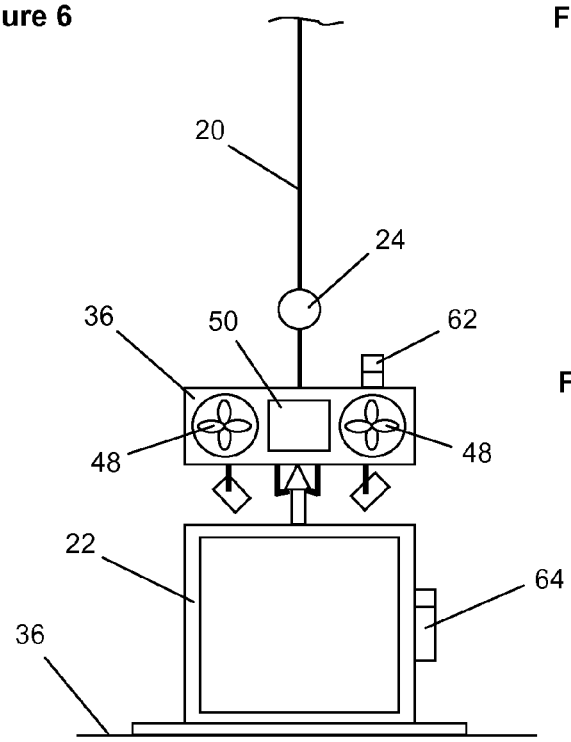
Figure 9:
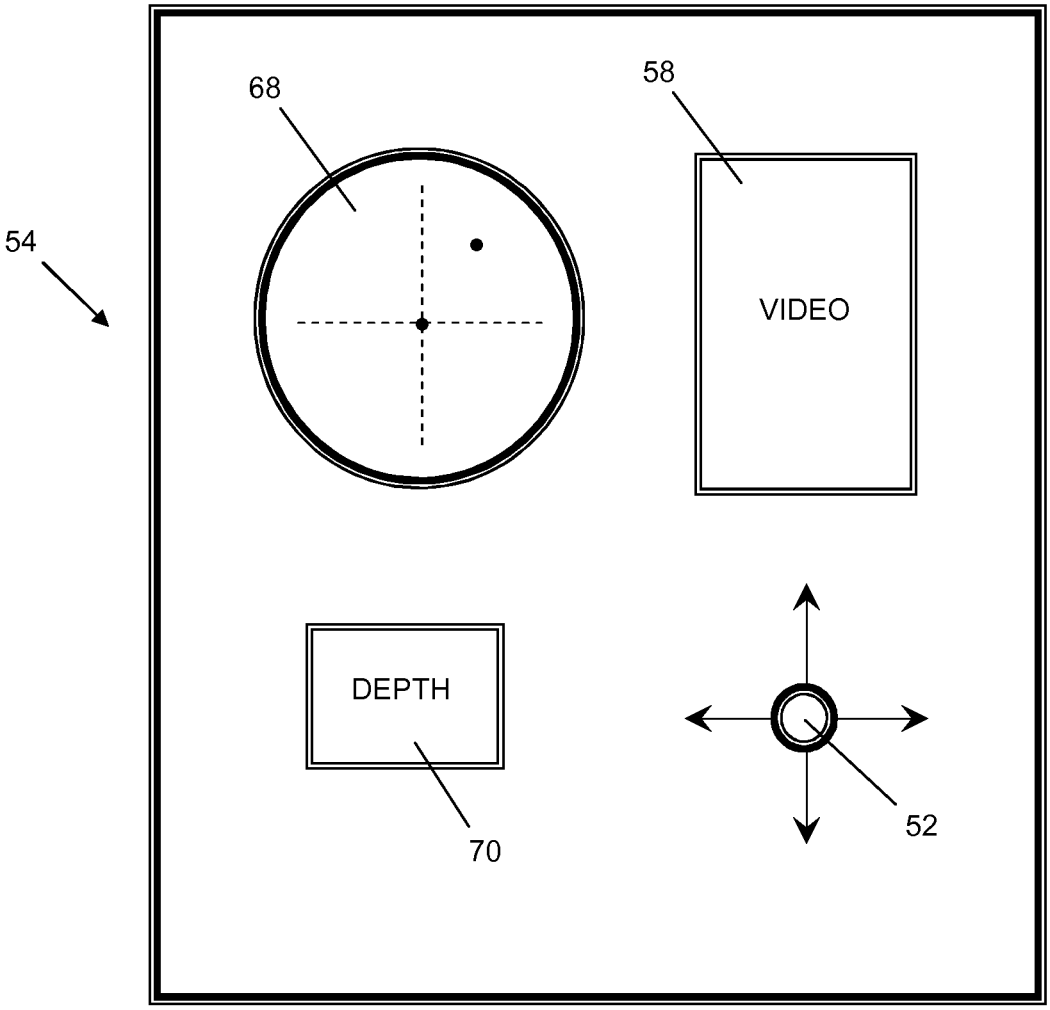

FIG. 4 corresponds to FIG. 3 but shows the latch unit disengaged and returning to the support vessel after the AUV basket has been landed on the seabed;

FIG. 5 corresponds to FIG. 4 but shows a latch unit returning to and approaching the AUV basket for recovery;

FIG. 6 corresponds to FIG. 5 but shows the latch unit coming closer to the AUV basket due to movement on the x-, y-axes while being lowered;

FIG. 7 corresponds to FIG. 6 but shows the latch unit aligned with the AUV basket after final movement on the x-, y-axes and hence being ready for docking, a position also shown in FIG. 2;

FIG. 8 corresponds to FIG. 7 but shows the latch unit docked with the AUV basket, which is therefore now ready for recovery to the support vessel; and FIG. 9 is a schematic front view of a control unit, showing controls and displays that may be presented to a pilot who controls movement of the latch unit in use.

Two methods in accordance with the invention are described in detail below. Both use an AUV garage or basket delivered to the seabed as an example of a payload, although the invention may be used with other payloads that require delivery to or recovery from the seabed or other subsea locations, including mid-water locations. In each case, the subsea location is wholly underwater or subsurface so that the payload is fully submerged while connected to a lift line at that location.

The first method leaves the payload attached to a lift line and is described with reference to FIG. 1. Where the payload is an AUV basket as in this example, the basket may simply launch and/or recover an AUV (not shown) during a brief stay on the seabed in which the basket remains connected to the support vessel by the lift line.

The second method, described with reference to FIGS. 2 to 9, is an extension of the first method. It allows a payload to be left on the seabed or released at another subsea location—including mid-water—for collection or recovery at a later time. This is appropriate where the payload is an AUV basket with garage or dock facilities to be left on the seabed, to which an AUV may return periodically for protection, replenishment or recharging, and eventually for recovery.

Figure 1:
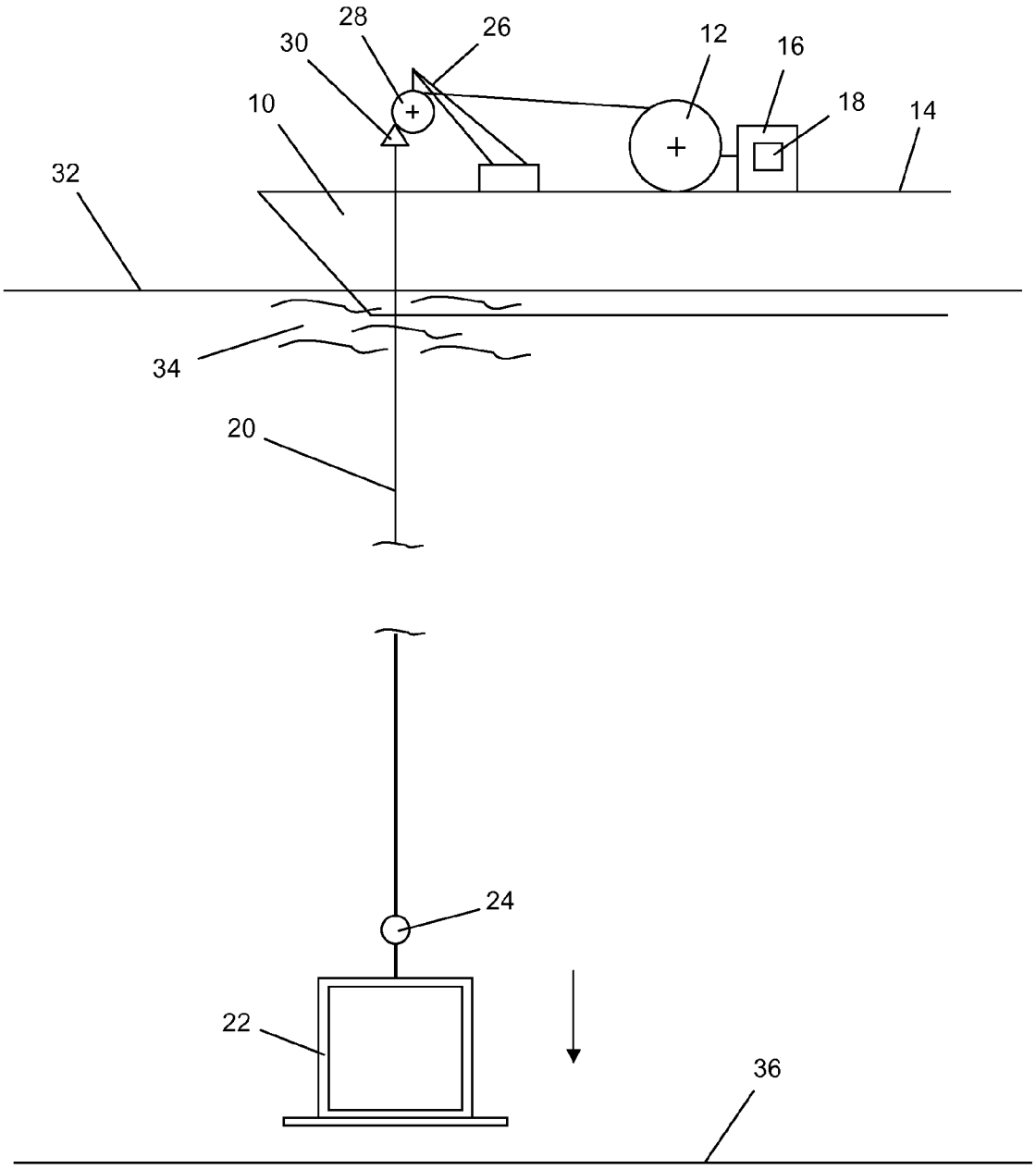
FIG. 1 is a schematic side view of a first embodiment of the invention in use, while lowering an AUV basket from a support vessel to the seabed.

Referring firstly to FIG. 1 of the drawings, a support vessel 10 has an active heave-compensated winch 12 mounted on its deck 14. The winch 12 is driven by a power pack 16 controlled by a winch controller 18. The winch 12 acts on a lift line 20 that is typically of steel wire but could be of other materials. The lift line 20 has power and communications cores within it to serve as an umbilical.

The lift line 20 supports a payload, in this case a basket 22 for an AUV. The lift line 20 carries a load pin 24 near the basket 22 that senses local tension in the lift line 20 for use in controlling the winch 12, as will be explained. In essence, however, the basket 22 is connected directly to the lift line 20 in a manner that transmits tension from the lift line 20 to the basket 22 without an intermediate umbilical or other slack line.

The vessel 10 has a launch-and-recovery crane 26 supporting a sheave 28 over which the lift line 20 runs where it extends from the winch 12 to the basket 22. The sheave 28 has built-in damper spring compensators to keep snatch loads within the safe working limits of the lift line 20. A latch 30 associated with the sheave 28 takes the weight of the basket 22 when it is raised above the surface 32.

In a launch operation, the crane 26 lifts the basket 22 over the side of the vessel 10 while the basket 22 remains attached to the sheave 28 by the latch 30. The load of the basket 22 is then transferred to the winch 12 through the lift line 20, whereupon the latch 30 is opened and the basket 22 is lowered through the splash zone 34 as the winch 12 pays out the lift line 20. Snatch loads caused by slack in the lift line 20 as the basket 22 transits the splash zone 34 in high sea states are mitigated by the damper springs in the sheave 28.

The basket 22 is lowered until it is close to the seabed 36, typically to within an altitude of twenty meters. At this stage, active heave compensation (AHC) mode is switched on in the winch controller 18. In AHC mode, vessel movement is measured by a motion sensor in the winch controller 18 and the winch 12 is driven by the power pack 16 to counteract that motion, keeping the basket 22 at a substantially fixed altitude above the seabed 36 as the vessel 10 heaves.

With continued compensation for heave motion of the vessel 10 in AHC mode, the basket 22 is then lowered slowly under manual or automatic control toward the seabed 36. When the basket 22 lands on the seabed 36, the winch controller 18 is switched manually or automatically to AHC constant-tension mode. In this mode, active heave compensation continues but the load pin 24 provides a drive signal offset to the AHC system of the winch controller 18 so that a predetermined load is maintained in the lift line 20. This ensures that the lift line 20 will not drop onto the basket 22.

To recover the basket 22, a lift-off function is enabled in the winch controller 18. Initially the winch controller 18 operates the winch 12 in AHC mode. The lift-off function slowly increases tension in the lift line 20 measured by the load pin 24 until the basket 22 pulls clear of the seabed 36. This slow increase in tension in the lift line 20 ensures that resistance to movement of the basket 22 caused by adhesion or suction between the basket 22 and the seabed 36 is progressively overcome. This reduces the ultimate tension that must be applied through the lift line 20 to disengage the basket 22 from the seabed, and ensures that just enough tension is applied to do so. Snatch loads in the lift line 20 are thereby reduced when the basket 22 breaks free.

When the basket 22 reaches a sufficient altitude above the seabed 36, AHC mode may be switched off in the winch controller 18. The basket 22 can then be raised to the surface 32 and back into engagement with the latch 30 of the sheave 28 for recovery to the deck 14 of the vessel 10.

Moving on now to FIGS. 2 to 9, the system shown in those drawings is an evolution of the system shown in FIG. 1; like numerals are used for like parts.

FIGS. 2 to 8 show a flying latch unit 38 at the end of the lift line 20 that may be latched to and unlatched from the basket 22. This allows the basket 22 to be left on the seabed 36 while the vessel 10 departs and subsequently to be recovered back to the vessel (which of course need not be the same vessel) as necessary.

The latch unit 38 and the basket 22 have complementary latch parts 40, 42 for this purpose, namely a downwardly-opening female latch part 40 on an underside of the latch unit 38 and a male latch part 42 projecting upwardly from an upper side of the basket 22. Other latch configurations are possible depending on detailed design requirements; for example, the female latch part might not be downward-opening but could instead be inverted.

The male latch part 42 is a stud with an enlarged upwardly-tapering head 44 that engages with pivotable jaws 46 of the female latch part 40. The engaged state is shown in FIGS. 2 and 8. The jaws 46 pivot to admit the head 44 of the stud upon engagement of the latch unit 38 with the basket 22 and are pivoted again to release the head 44 when disengagement is required, as shown in FIG. 3.

As before, a load pin 24 is disposed on the lift line 20 to enable the winch controller 18 to control local tension in the lift line 20 via the winch 12. In this instance, the load pin 24 is positioned above the latch unit 38. However, the load pin 24 could instead be incorporated into the latch unit 38. Again, the basket 22 is connected to the lift line 20 in a manner that transmits tension from the lift line 20 to the basket 22 without an intermediate umbilical or other slack line, albeit in this case via the latch unit 38.

The latch unit 38 comprises reversible thrusters 48 arranged in pairs acting along parallel generally horizontal axes, by which the latch unit 38 can be moved, steered, oriented and flown underwater in a horizontal plane defined by x- and y-axes. Whilst only one pair of thrusters 48 is visible in the drawings, there could be more than one pair of thrusters 48. For example, four thrusters 48 arranged in two pairs acting on mutually orthogonal axes would allow thrust in each direction without having to alter the heading of the latch unit 38.

Whilst the latch unit 38 could have a further ability to apply thrust vertically to move itself up and down in the water column, it is envisaged that vertical z-axis movement of the latch unit 38 may be effected principally or exclusively by moving the lift line 20 with the winch 12.

The latch unit 38 has an on-board control module 50 with heading, depth and altitude sensors. With feedback from those sensors of the control module 50, movement of the latch unit 38 is controlled by a pilot operating a joystick 52 of a control unit 54 on the vessel 10. The control unit 54 is shown schematically in FIG. 9. The latch unit 38 is connected to the control unit 54 by an umbilical data connection integrated into the lift line 20.

The operation of the control unit 54 is linked to that of the winch controller 18 to synchronise their actions where necessary, for example by operating the winch 12 to effect z-axis movement of the latch unit 38 when a pilot moves the joystick 52 of the control unit 54 accordingly.

The latch unit 38 further comprises a video camera 56 on its underside that feeds a video signal to the control unit 54 for display to the pilot on a monitor 58 on the control unit 54. This video display is used to aid final docking of the latch unit 38 with the basket 22 by enabling the pilot to align the female latch part 40 with the head 44 of the stud. The underside of the latch unit 38 also has a light 60 for this purpose.

The position of the latch unit 38 when underwater is signalled by an acoustic responder/transponder 62 carried by the latch unit 38. The basket 22 also has a transponder 64. The positions of both transponders 62, 64 are suitably determined by an acoustic positioning system such as a USBL (ultra-short baseline) system 66 carried by the vessel 10. The relative positions of the transponders 62, 64 are displayed conveniently to the pilot on a navigation display 68 of the control unit 54. The navigation display 68 enables the pilot to steer the latch unit 38 toward the stationary transponder 64 of the basket 22 on the x-, y-axes as the latch unit 38 is lowered on the z-axis by the winch 12 paying out the lift line 20. A depth display 70 is also provided on the control unit 54.

Thus, this second method of the invention employs a flying basket latch unit 38 that may be used to leave the basket 22 on the seabed 36. In effect, the latch unit 38 is a steerable latch or hook fitted to the end of the lift line 20 that can be propelled on the x-, y-axes as it moves in the z-axis. Steering on the x-, y-axes during lowering on the z-axis effectively guides the latch unit 38 to the basket 22 within a downwardly-tapering conical volume.

The launch process of the second method mirrors that of the first method until the basket 22 is on the seabed 36, save that in this case the basket 22 initially attaches to the latch 30 of the sheave 28 indirectly, via the latch unit 38. FIG. 3 shows the basket 22 approaching the seabed 36.

On landing on the seabed 36, the latch parts 40, 42 are disengaged to free the latch unit 38 from the basket 22 and the latch unit 38 is lifted clear of the basket 22 as shown in FIG. 4. When there is sufficient clearance between the latch unit 38 and the basket 22, AHC mode can be switched off and the latch unit 38 may then be recovered to the vessel 10 by reeling in the lift line 20 onto the winch 12.

When the basket 22 is to be recovered as shown in the sequence of FIGS. 5 to 8, the vessel 10 is positioned over the basket 22 using known techniques such as a vessel-based USBL acoustic positioning system 66 detecting the transponder 64 on the basket 22. The latch unit 38 is lowered to a position close to the position of the basket 22, again typically within twenty meters of vertical separation. A comparison is made between the positions of the transponders 62, 64 on the latch unit 38 and the basket 22, and their relative positions on the x-, y-axes are displayed to a pilot on the navigation display 68 of the control unit 54 as shown in FIG. 9.

Then, with AHC mode activated on the winch 12 to compensate for heave motion of the vessel 10, the pilot uses the joystick 52 and the navigation display 68 of the control unit 54 to drive the latch unit 38 in the x-, y-axes. The dots shown on the navigation display 68 shown in FIG. 9 represent the transponders 62, 64 on the latch unit 38 and the basket 22 and the pilot's initial objective is to bring those dots into alignment. The pilot also views the depth display 70 and the monitor 58 beside the navigation display 68 to watch for when the basket 22 becomes visible below the latch unit 38.

The latch unit 38 is driven actively to close any gap on the x-, y-axes between the transponders 62, 64 on the latch unit 38 and the basket 22, while lowering the latch unit 38 along the z-axis by paying out the lift line 20 from the winch 12. In this way, the latch unit 38 is directed toward the basket 22 as the latch unit 38 descends. The lift line 20 may then be latched to the basket 22 via the latch unit 38, by using the video camera 56 and the light 60 to guide the final approach of the latch unit 38 to the basket 22.

Once the latch unit 38 is latched to the basket 22, the winch controller 18 is switched to AHC constant-tension mode to maintain tension on the lift line 20. This prevents the lift line 20 dropping onto the basket 22. The basket 22 is then recovered from the seabed 36 to the vessel 10 in the same way as described in the first method above.

Many variations are possible within the inventive concept. For example, as noted above, the invention may be used to deliver a payload to, or to recover a payload from, a subsea location other than the seabed, such as a mid-water location. This may be useful for deploying or recovering a subsea vehicle such as an AUV to or from anywhere in the water column, if the vehicle is fitted with an appropriate transponder.

Also, in principle, it would be possible for the latch unit 38 to determine the relative position of the basket 22 via the transponder 64 or otherwise, and to convey that relative positional information back to the control unit 54.

The invention may be used to deploy various general packages to, and to recover them from, the seabed or other underwater locations. For example, the invention may be used to deploy multiple packages to be assembled on the seabed or on an underwater structure. Another example of a payload that may be deployed and recovered by the invention is a remotely-controlled or autonomous crawler-type vehicle that operates on the seabed.

The invention claimed is:

1. A method of lifting a payload from a seabed location, comprising:

flying a latch unit through the water to the payload, the latch unit being attached to a taut lift line supported by a heave-compensating winch on a surface vessel to carry the lift line toward the payload;

wherein flying the latch unit comprises moving the latch unit on x- and y-axes horizontally to align the latch unit above the payload before attachment of the latch unit to the payload, while controlling a z-axis position of the latch unit using the heave-compensating winch;

attaching the latch unit to the payload;

progressively increasing tension applied through the lift line via the latch unit to detach the payload from a seabed location; and lifting the payload using the tension applied through the lift line via the latch unit.

2. The method of claim 1, comprising lowering the latch unit on a z-axis toward the payload by paying out the lift line from the winch during movement of the latch unit on the x- and/or y-axes.

3. The method of claim 1, comprising determining underwater positions of the latch unit and the payload and flying the latch unit while monitoring its changing position to converge with the position of the payload.

4. The method of claim 1, wherein the latch unit is suspended from the lift line with negative buoyancy.

5. The method of claim 1, wherein heave compensation by the winch is activated when the latch unit is at a mid-water position nearing, but vertically spaced from, the payload.

6. The method of claim 5, comprising detecting attachment of the latch unit to the payload and, in response to attachment, applying tension to the lift line using the winch.

7. The method of claim 6, comprising sensing local tension in a portion of the lift line closely adjacent the payload to control the winch.

8. The method of claim 1, preceded by lowering the latch unit from the surface vessel on the lift line.

9. The method of claim 1, preceded by lowering the payload to the underwater location attached to the latch unit attached, in turn, to the lift line; detaching the latch unit from the payload; and lifting the latch unit clear of the payload using the lift line.

10. The method of claim 9, comprising lowering the payload from the surface vessel through a splash zone while damping movement of the lift line.

11. The method of claim 1, wherein the payload is an AUV or an AUV garage.

12. A system for recovering a payload from an seabed location, the system comprising:

a lift line;

a thruster-equipped latch unit attached to the lift line and steerable in x- and y-axes horizontally through water to carry the lift line toward a payload at an underwater location, the latch unit having a latch formation to attach the latch unit to the payload, and being arranged to transmit lifting tension from the lift line to the payload via the latch formation to recover the payload;

a heave-compensating winch which in use pays out the lift line to lower the latch unit toward the payload, controls a z-axis position of the latch unit during lowering, and increases the tension applied through the lift line via the latch unit is progressively increased to detach the payload from a seabed location.

13. The system of claim 12, wherein the lift line is attached to one side of the latch unit and the latch formation is disposed on an opposite side of the unit to transmit tension from the lift line through the unit to the payload.

14. The system of claim 12, comprising;

a position-detection apparatus for detecting underwater positions of the latch unit and the payload; and a control apparatus acting on the winch and the latch unit to direct the latch unit to the payload.

15. The system of claim 14, wherein the control apparatus is arranged to control one or more thrusters of the latch unit to move the latch unit on x- and/or y-axes and to control the winch to lower the latch unit on a z-axis by paying out the lift line from the winch.

16. The system of claim 14, further comprising a lift line tension sensor adjacent to or integrated with the latch unit whose signal is used by the control apparatus to control the winch.

17. A surface support vessel having the system of claim 12.

* * * * *